US010414037B1

(12) United States Patent
Heavrin

(10) Patent No.: US 10,414,037 B1
(45) Date of Patent: Sep. 17, 2019

(54) HAMMER DRILL ADAPTER FOR DRIVING CLEATS ONTO SHEET METAL EDGES

(71) Applicant: Michael Heavrin, Lutherville, MD (US)

(72) Inventor: Michael Heavrin, Lutherville, MD (US)

( * ) Notice: Subject to any disclaimer, the term of this patent is extended or adjusted under 35 U.S.C. 154(b) by 0 days.

(21) Appl. No.: 16/141,575

(22) Filed: Sep. 25, 2018

(51) Int. Cl.
*B25D 17/02* (2006.01)
*B25D 17/08* (2006.01)

(52) U.S. Cl.
CPC ..... *B25D 17/02* (2013.01); *B25D 17/08* (2013.01); *B25D 2217/0003* (2013.01)

(58) Field of Classification Search
CPC ..... B25B 21/00; B25B 21/007; B25D 17/06; B25D 2217/0019; B25D 17/00; B25D 17/02; B25D 17/08; B25D 2217/0003
USPC ..... 173/29, 1, 2, 130, 164, 176, 179, 183, 173/217
See application file for complete search history.

(56) References Cited

U.S. PATENT DOCUMENTS 273,382 A * 3/1883 Packham ..... B25B 7/02 72/409.19
354,657 A * 12/1886 Rowe ..... B25B 27/146 72/409.01
520,212 A * 5/1894 McKenzie ..... B66C 1/422 294/118
755,440 A * 3/1904 Bonschur ..... G02C 13/001 81/3.6
828,625 A * 8/1906 Ogg ..... B25B 9/02 24/40
1,484,100 A * 2/1924 Wertz ..... F24B 15/10 294/11
1,538,808 A * 5/1925 Hedeen ..... A47G 21/045 100/234
1,723,597 A * 8/1929 Bannister ..... B25B 9/00 294/106
1,948,592 A * 2/1934 Nelson ..... A47G 21/045 294/7
1,949,452 A * 3/1934 Chadwick ..... A22C 25/06 294/118
2,130,748 A * 9/1938 Suter ..... A45D 4/06 132/211
D127,728 S * 6/1941 Tonelli ..... 294/99.2
(Continued)

*Primary Examiner* — Robert F Long
(74) *Attorney, Agent, or Firm* — Larry J. Guffey, Esq.; Pamela K. Riewerts, Esq.; Oliver & Grimsley, LLC

(57) ABSTRACT

An improved hammer drill adapter, that is to be inserted into the variable-diameter, chuck end of a hammer drill for driving forward any one of a plurality of different types of sheet metal cleats to join the opposing ends of two sheet metal, duct sections, includes: (a) an elongated shaft having a drive end and a working end and a centerline between said ends, (b) the drive end configured to be releasably held in the hammer drill's chuck, (c) the working end having an elongated flat, front face that has top and bottom surfaces, two ends and with the front face oriented so that a perpendicular to the front face is parallel to the shaft's centerline, (d) the front face has an elongated cavity and a front face channel that are oriented approximately perpendicular to each other, and (e) wherein this cavity is configured to accommodate within it the end of a flat drive cleat, and the cavity and front face channel together are configured to accommodate within them the end of a standing drive cleat.

16 Claims, 4 Drawing Sheets

(56) References Cited

U.S. PATENT DOCUMENTS 2,585,089 A * 2/1952 Caldwell ..... B63B 21/08 114/294
2,670,234 A * 2/1954 Roop ..... A47G 21/10 294/99.2
2,674,793 A * 4/1954 Dominick ..... A47G 21/10 100/234
2,892,655 A * 6/1959 Bower ..... A47J 43/283 126/9 B
2,929,166 A * 3/1960 Sneide ..... A01K 97/00 119/6.7
3,583,821 A * 6/1971 Shaub ..... B23B 51/044 408/212
3,611,842 A * 10/1971 Skipper ..... B23K 3/087 269/157
3,881,838 A * 5/1975 Derbyshire ..... B23Q 11/0053 144/252.1
4,033,037 A * 7/1977 Cooley ..... B21D 28/24 30/363
4,068,377 A * 1/1978 Kimmel ..... B23B 31/001 408/241 G
4,223,936 A * 9/1980 Jorgensen ..... A47G 21/02 294/7
4,317,282 A * 3/1982 Pace ..... A01D 34/416 30/276
4,386,461 A * 6/1983 Plummer ..... H01R 43/015 29/749
4,826,136 A * 5/1989 Thomas ..... B25C 11/00 254/131
4,848,309 A * 7/1989 Alderete ..... A01D 34/412 173/170
4,940,370 A * 7/1990 Gipson ..... B25B 27/18 29/802
4,955,971 A * 9/1990 Goulter ..... A47J 43/283 294/3
5,054,226 A * 10/1991 Hart ..... A01K 97/18 294/16
5,168,783 A * 12/1992 Shea ..... B25B 7/02 81/418
5,217,464 A * 6/1993 McDonald ..... A61F 2/1662 24/552
5,219,378 A * 6/1993 Arnold ..... B26B 7/00 156/763
5,310,341 A * 5/1994 Byer ..... B25D 3/00 125/40
5,403,052 A * 4/1995 Lampron ..... A47J 43/288 294/7
5,427,188 A * 6/1995 Fisher ..... B25D 11/102 173/205
5,469,623 A * 11/1995 Roeker ..... B26B 7/00 30/169
5,513,709 A * 5/1996 Fisher ..... B25D 11/08 173/170
5,601,323 A * 2/1997 Kaiser ..... A47J 37/0786 294/118
5,634,679 A * 6/1997 Hilderbrandt ..... A47J 43/283 294/8
5,640,772 A * 6/1997 Roeker ..... B26B 7/00 30/169
5,791,053 A * 8/1998 Koong ..... A47G 21/10 294/99.2
5,862,658 A * 1/1999 Howard ..... A61C 3/02 433/116
5,865,072 A * 2/1999 Jerdee ..... B25B 7/02 81/424.5
5,934,721 A * 8/1999 Walde ..... A47J 37/0786 294/3
6,120,220 A * 9/2000 Speare ..... A01D 34/84 172/111
6,175,998 B1 1/2001 Leo
D450,992 S * 11/2001 Abshire ..... D8/14
6,328,505 B1 * 12/2001 Gibble ..... B23B 51/05 408/1 R
6,598,775 B1 * 7/2003 Chen ..... B25B 21/02 81/466
6,681,756 B1 * 1/2004 Kilpatrick ..... B25C 7/00 227/113
6,776,615 B2 * 8/2004 Dietrich ..... A61C 3/10 433/159
7,065,883 B2 * 6/2006 Popeil ..... A47J 43/283 294/26
7,096,972 B2 * 8/2006 Orozco, Jr. ..... B25D 11/102 173/114
D545,648 S * 7/2007 Pulling ..... D8/14
7,261,348 B1 * 8/2007 Fried ..... A47G 21/10 294/16
7,765,631 B2 * 8/2010 Fisher ..... B23Q 5/027 15/236.01
D715,121 S * 10/2014 Lai ..... D8/52
9,180,584 B1 11/2015 Cook
D763,048 S * 8/2016 Murphy ..... D8/52
9,481,074 B2 * 11/2016 Lesche ..... B25B 5/147
9,561,546 B1 * 2/2017 Walter ..... B23B 39/00
9,701,036 B2 * 7/2017 Dion ..... B26F 1/36
9,848,590 B2 * 12/2017 Pangrcic ..... A01K 97/04
2003/0041704 A1 * 3/2003 Pelt ..... B25H 1/0092 408/16
2004/0191016 A1 * 9/2004 Hintze ..... B23B 49/008 408/67
2004/0240954 A1 * 12/2004 Chilcott ..... E21B 7/008 408/239 A
2005/0105980 A1 * 5/2005 Davis ..... B23B 51/0433 408/199
2006/0257220 A1 * 11/2006 Gertner ..... B23B 49/005 408/202
2007/0158089 A1 * 7/2007 Chen ..... B25D 9/04 173/210
2007/0193430 A1 * 8/2007 Jang ..... G10D 3/006 84/313
2009/0084567 A1 * 4/2009 Basham ..... B25C 7/00 173/29
2009/0188690 A1 7/2009 Rodola, Jr.
2010/0018365 A1 * 1/2010 Tyler ..... B25B 5/12 81/423
2010/0019014 A1 * 1/2010 Rodenhouse ..... B25B 21/002 227/32
2010/0058895 A1 * 3/2010 Wu ..... B25B 7/123 81/9.3
2010/0107823 A1 * 5/2010 Wu ..... B25B 7/123 81/9.3
2012/0042710 A1 * 2/2012 Polofsky ..... B25B 7/04 72/409.16
2012/0255749 A1 * 10/2012 Seith ..... B25B 13/06 173/1
2013/0228046 A1 * 9/2013 Wu ..... B25B 7/02 81/9.3
2015/0217431 A1 * 8/2015 Seith ..... B25B 13/06 81/121.1
2015/0217433 A1 * 8/2015 Seith ..... B25B 23/0035 81/124.6
2017/0028537 A1 * 2/2017 McClung ..... B25B 21/026
2017/0197305 A1 * 7/2017 Rastegar ..... B25F 3/00
2017/0297178 A1 * 10/2017 Hsieh ..... B25B 21/02
2018/0043520 A1 2/2018 Aho
2018/0141190 A1 * 5/2018 Prunean ..... B25B 31/00

* cited by examiner

HAMMER DRILL ADAPTER FOR DRIVING CLEATS ONTO SHEET METAL EDGES

BACKGROUND OF THE INVENTION

1. Field of the Invention

The present invention relates generally to sheet metal fabrication tools and methods, and, more particularly to an adapter that is used with a hammer drill for driving any one of a plurality of different types of cleats onto the opposing ends of two sheet metal sections that are to be joined together and used in typical heating ventilation and air-condition (HVAC) applications.

2. Description of the Related Art

In HVAC applications and the installation of other types of air flow systems, both the sections of the air ducts that are-to-be-joined and the cleats that are used to hold them together are typically made from galvanized steel, aluminum or stainless steel. The ends of the duct sections that are to be joined are typically configured to have a lip, an indentation or other configuration in order to help in joining the sections to the cleats.

Until relatively recently, a common handheld hammer was used to impact the end of a cleat in order to drive it onto the sometimes especially configured and adjoining ends of the sections that were to be joined together with a cleat. Since air ducts are typically overhead, sheet metal workers typically had to stand on a ladder to drive the cleat. Using a repetitive, upward shoulder force, the sheet metal worker would swing a hammer impacting one end of the cleat so as to force it into position connecting the ducts.

However, this method was time consuming, the cleats were difficult to maneuver and sometimes led to bent cleats during the installation process. In addition, this repetitive, overhead, manual, impact motion was physically very stressful for the sheet metal worker and would sometimes cause shoulder and other injuries to the workers tasked with installing the cleats.

The recent development of a "hammer drill" and its associated adapters has made the task of installing some types of cleats much less stressful on the installer or sheet metal worker. This situation is such because the hammer drill, that is now sometimes used in such applications, is designed to have its chuck move forward and backward on the centerline of the drill in order to apply a series of relatively small amplitude, but high frequency hammering motions that help to allow anything that is being held by and protruding forward from the drill's chuck to be moved forward when comparatively small amounts of pressure are applied in a forward direction to the hammer drill's grip.

However, the use of such hammer drill is still relatively limited because the adapters that have been designed to be used with them, see U.S. Patent Publication Nos. (USPPN) 20180043520 and 20090188690, can still not handle a wide range of differing types of cleats and there still are problems with bending the cleats when using such hammer drills & the current adapters to install the cleats.

What is needed are improved hammer drill adapters and the methods for installing such cleats. These needed, improved adapters and their methods need to accommodate a wider range of differing types of adapters, reduce the incidences of bent cleats when trying to install them, reduce the time required to safely install such cleats, and further reduce the resulting impact forces and stresses applied to the sheet metal workers who install such cleats.

SUMMARY OF THE INVENTION

Recognizing the need for the development of improved hammer drill adapters, the present invention seeks to provide such improved hammer drill adapters.

In accordance with a preferred embodiment of the present invention, an improved hammer drill adapter, that is to be inserted into the variable-diameter, chuck end of a hammer drill for driving forward any one of a plurality of different types of sheet metal cleats to join the opposing ends of two sheet metal, duct sections, includes: (a) an elongated shaft having a drive end and a working end and a shaft centerline between said ends, (b) the drive end configured to be releasably held in the hammer drill's chuck, (c) the working end having an elongated flat, front face, a top and a bottom surface and two ends and with the front face oriented so that a perpendicular to the front face is parallel to the shaft's centerline, (d) the front face has an elongated cavity and a front face channel that are oriented approximately perpendicular to each other, and (e) wherein the cavity is configured to accommodate the end of a flat drive cleat, and the cavity and front face channel together are configured to accommodate the end of a standing drive cleat within the cavity and the channel.

In accordance with a further example of this preferred embodiment of an improved hammer drill adapter, its front face is configured so that its cavity is sized so that it has a prescribed open space or gap between any end of a cleat that has been inserted into the cavity and its adjoining ends and sides.

In accordance with another example of this preferred embodiment of an improved hammer drill adapter, its front face is further configured so that it has an elongated end-to-end channel that extends between the ends of the front face, and this end-to-end channel is configured to accommodate a portion of the side of a flat, S-cleat within this end-to-end channel.

In accordance with yet another example of this preferred embodiment of an improved hammer drill adapter, the top and bottom surfaces of its front face are separated by a prescribed heigth that is set so as to allow the front face to be used to push forward the open side of a standing S cleat, that also has extending from it the cleat's standing portion, onto the edge of one of the two duct sections that are to be joined together.

In accordance with a still further example of this preferred embodiment of an improved hammer drill adapter, its front face has dimensions in the range of 1.75-2.5 inches in length between its ends, and 0.8-1.25 inches in height between its top and bottom surfaces.

Thus, there has been summarized above (rather broadly and understanding that there are other preferred embodiments which have not been summarized above) the present invention in order that the detailed description that follows may be better understood and appreciated.

DESCRIPTION OF THE PREFERRED EMBODIMENT

Figure 1:
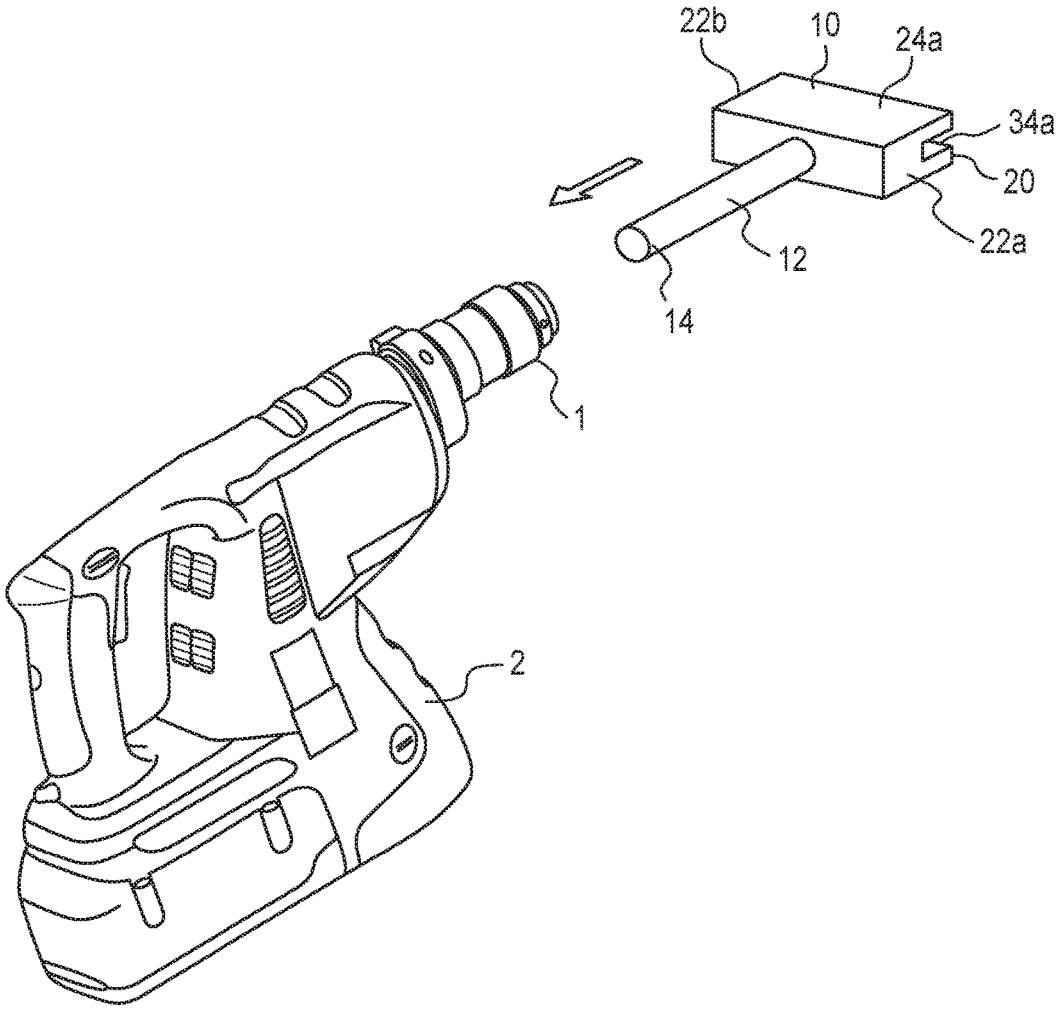
FIG. 1 is a perspective view of a preferred embodiment of the present invention that is about to be inserted into the chuck end of a hammer drill.

Before explaining at least one embodiment of the present invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Referring to FIG. 1, there is illustrated a perspective view of a preferred embodiment of the present invention 10. In this embodiment, the present invention takes the form of a hammer drill adapter 10 that is-to-be inserted into the chuck end 1 of a hammer drill 2 and used for driving any one of a plurality of different types of cleats (e.g., flat drive 3, flat S-cleat 4, standing drive 5, standing S-cleat 6) onto the is opposing ends of two sheet metal, duct sections that are to be joined together using such a cleat.

Figure 2A:
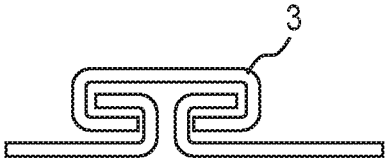
FIGS. 2A-2D show examples of the end views of some of the types of cleats that are inserted into the opening in the front face of the present invention whose rear end is held by the chuck end of a hammer drill that is used to drive the cleats onto the adjoining ends of two sections of sheet metal ducting that are to be joined together by the cleats.
Figure 2B:
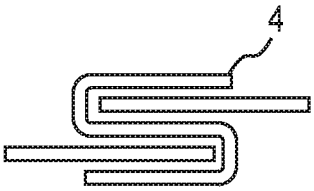
Figure 2C:
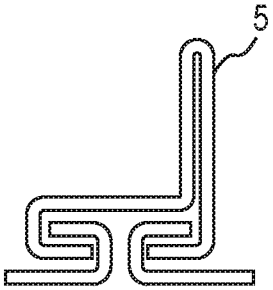
Figure 2D:
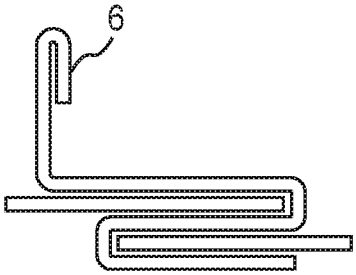

All such types of sheet metal, duct-section-joining cleats share, because of their intended use, some common characteristics, i.e., they all are elongated members that have two ends and each type has a differing, uniform, cross sectional shape. Thus, the end views of each of such cleats gives us a relatively complete description of the geometries of such cleats. See FIGS. 2A-2C for examples of the end views of the following types of cleats: (a) a flat drive 3 that is being used to join two duct sections that have non-overlapping ends which have been bent backwards onto themselves so that they form a quasi, U-shaped end, (b) a flat S 4 that is being used to join two duct sections that have overlapping, straight edge ends, and (c) a standing S 6 that is also being used to join two duct sections that have overlapping, straight edge ends.

Figure 3:
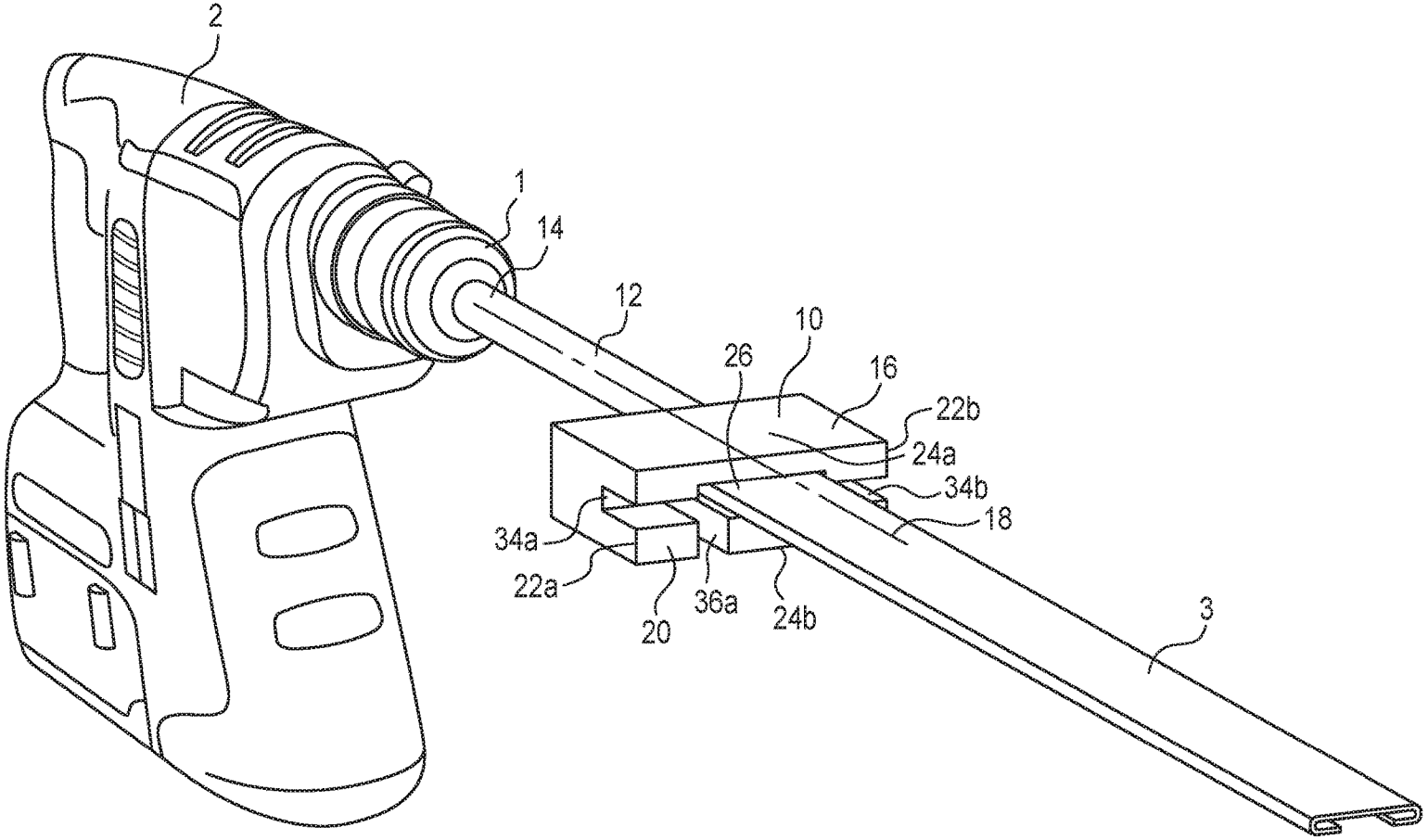
FIG. 3 is a perspective view of a flat drive cleat that has been inserted into an opening or elongated cavity in the front face of the present invention whose drive or rear end is held by the chuck end of a hammer drill that is about to be used to drive this cleat onto the adjoining or opposing ends of two sections of sheet metal ducting that are to be joined together by the cleat.

FIG. 3 shows a perspective view of a flat drive cleat 3 that has been inserted into an opening or elongated cavity 26 in the front face 20 of the present invention whose drive or rear end 14 is held by the chuck end 1 of a hammer drill 2 that is about to be used to drive this cleat onto the adjoining or opposing ends of two sections of sheet metal ducting that are to be joined together by the cleat.

Figure 4:
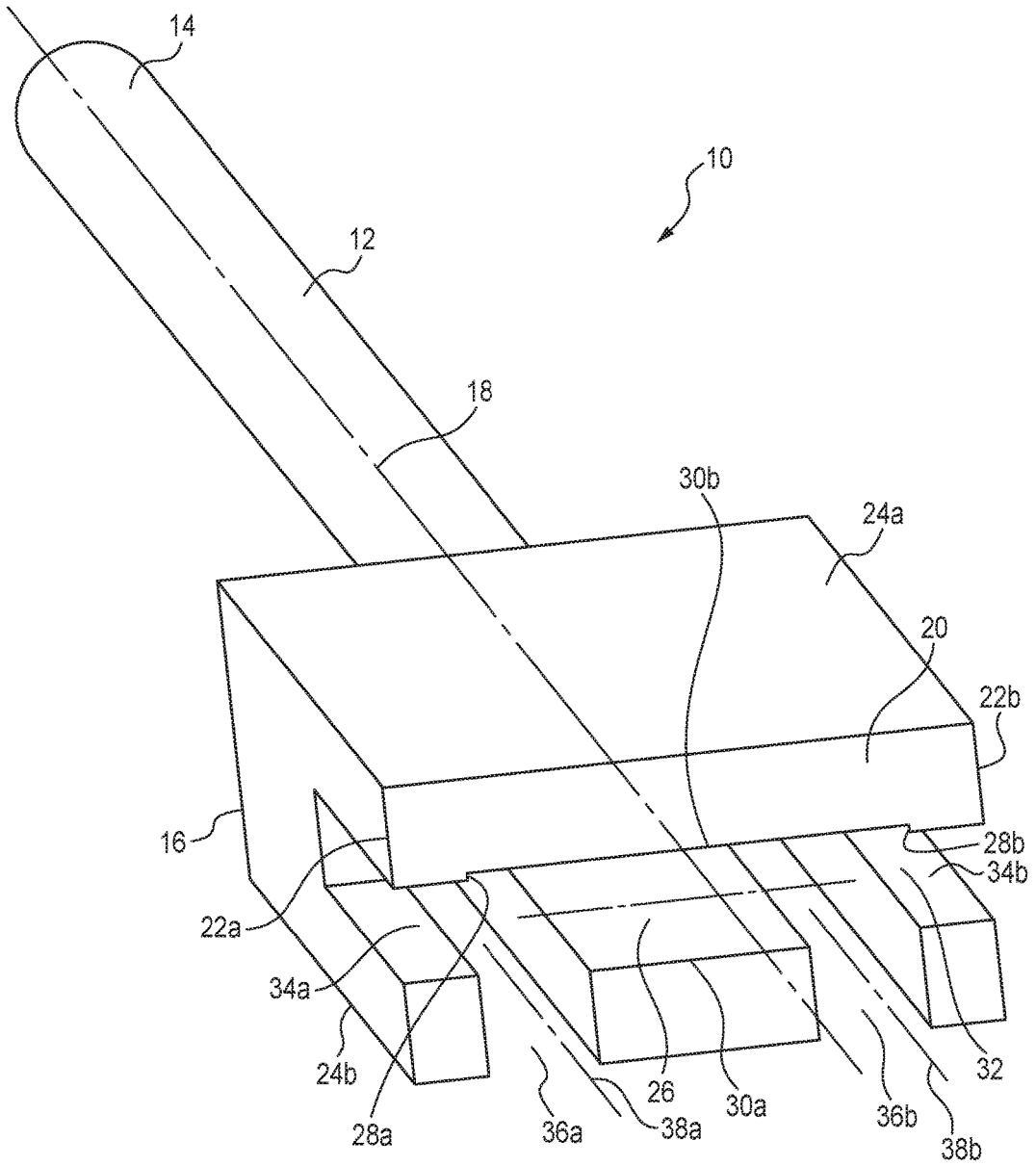
FIG. 4 is an enlarged, perspective view of a preferred embodiment of the present invention.

FIG. 4 shows an enlarged, perspective view of a preferred embodiment of the present invention. This adapter 10 is seen to have an elongated shaft 12 that has a drive end 14 and a working end 16 and a centerline 18 that extends between these ends. The drive end is in the shape of an elongated, tube that has a round, cross-sectional shape in order to allow this drive end to be releasably held in the variable-diameter, chuck or chuck end of a hammer drill 2. Typical dimensions for this elongated shaft are in the range of 3-5 inches in length, and a diameter of ¼-½ inches.

Such a hammer drill derives its name from the fact that its chuck moves forward and backward on the centerline 18 of the drill in order to apply a series of relatively small amplitude, but high frequency hammering motions that help to allow anything that is being held by and is protruding forward from the drill's chuck to be moved forward when pressure is applied to the hammer drill's grip 2*a* in this same, forward direction.

The forward or working end 16 of this drill has an elongated or rectangular flat, front face 20 that has two ends 22*a*, 22*b* and top 24*a* and bottom 24*b* surfaces. This front face is oriented with respect to the adapter's shaft so that a perpendicular to this front face that lies in the middle of it is parallel to or coincides with the centerline of the shaft 12. The height between the face's top and bottom surfaces is carefully prescribed so that the adapter's front face can be used to push forward an open side of a standing S cleat from which said standing portion extends onto the edge of one of two duct sections that are to be joined together. Since the height of the combined, oppositely-faced openings in a S cleat is in the range of ½-¾ inches, this sets the minimum height of the adapter's front face. Typical dimensions for this front face are in the range of 1.75-2.5 inches in length, 13/16-5/4 inches in height. The width of this working end from its rear to its front face is in the range of 1-1.75 inches. Preferred dimensions for this working end are 2 inches in length, 1 inch in height, and 1.25 inches in width.

An elongated cavity 26 extends between the ends 22*a*, 22*b* of the adapter. This cavity is seen to be configured to hold the end of one of the to-be-used cleats; see for example FIG. 3. This cavity is generally seen to have two, opposing cavity ends 28*a*, 28*b* and two, parallel cavity sides 30*a*, 30*b*, a cavity centerline 32 that extends between its ends, and a prescribed depth. This cavity is typically configured to allow the end of a flat drive cleat 3 or other such similar cleat to fit within it and have a prescribed play or gap between the cleat and the adjoining ends and sides of the cavity such that there is sufficient additional room that the cleat will not be held so tightly that a misalignment in the ends of the sheet metal sections that are to be joined together will result in the bending of the cleat. Gap or clearance dimensions on the order of 1/32-1/16 inches have been found to be sufficient to avoid such cleat bending. Typical dimensions for the overall cavity are in the range of 1.25-1.75 inches in length, ⅜-⅝ inches in width, and ⅜-¾ inches in depth.

Between each end of this cavity and the adjoining end of the front face, there is exists another shallower cavity or end channel 34*a*, 34*b* that is configured to hold other cleats (e.g., a flat S-cleat 4) that are to be pushed forward by the drive hammer when they are held on a portion of one of their elongated edges rather than on their ends. Since the front face's cavity has a void space between the ends from which each of these channels extend, these channels and the cavity combine to essentially a single, end-to-end channel that extends between the front face's ends. Typical dimensions for each of these end channels are in the range ¼-⅜ inches in width, and 3/16-5/16 inches in depth.

This front face also has a pair of front face channels 36*a*, 36*b*, each of which extends perpendicularly between the bottom of the front face and the adjoining side 30*b* of its cavity 26 and each of which is located proximate one of the cavity's ends. Each of these channels also has a rear end and a front end that is located in the front face and a front face channel centerline 38*a*, 38*b* that extends between these ends and and each of these is oriented so that the front face channel centerline is approximately parallel to the shaft's centerline 18. These front face channels 36*a*, 36*b* are provided for those instances when the adapter is tasked with pushing forward from an end a cleat that has a standing element (e.g., a standing drive 5, or a standing S-cleat 6) and this standing element is situated in one of these front face channels 36*a*, 36*b*. Typical dimensions for each of these front channels are in the range ¼-½ inches in width, and ¼-¾ inches in depth.

The foregoing is considered as illustrative only of the principles of the present invention. Further, since numerous modifications and changes will readily occur to those skilled in the art, it is not desired to limit the invention to the exact construction and operation shown and described herein. Accordingly, all suitable modifications and equivalents may be resorted to, falling within the scope of the invention that is hereinafter set forth in the claims to the invention.

I claim:

1. A hammer drill adapter that is inserted into the variable-diameter, chuck end of a hammer drill for driving forward any one of a plurality of different types of sheet metal cleats to join the opposing ends of two sheet metal, duct sections, and wherein each type of said cleat having two ends and opposing sides and a uniform, cross sectional shape, said hammer drill adapter comprising:

an elongated shaft having a drive end and a working end and a shaft centerline between said ends, wherein said drive end sized so as to be releasably held in said chuck end of said hammer drill, wherein said working end having an elongated flat, front face, a top and bottom surfaces and two ends, and said front face is oriented with respect to said shaft so that a perpendicular to said flat, front face is parallel to said centerline of said shaft, wherein said flat, front face having a fixed, elongated cavity that has two cavity ends which are separated by a cavity width, cavity top and bottom sides and a cavity centerline that extends between said cavity ends, wherein said flat, front face also having at least two front face channels each of which extends perpendicularly from said bottom side of said cavity and to said bottom surface of said working end, and has two sidewalls that are spaced apart a specified front face channel width, and also has a rear end and a front end that is located in said front face and has a front face channel centerline that extends between said ends and wherein said front face channel is oriented so that said front face channel centerline is parallel to said centerline of said shaft, wherein said cavity width sized to accommodate the end of a flat drive cleat within said cavity, and wherein said front face channel width of each of said front face channels is sized to accommodate the standing portion of the end of a standing drive cleat within said front face channel.

2. The hammer drill adapter as recited in claim 1, wherein:

said cavity further configured to provide a prescribed gap between said cleat and said ends and sides of said cavity.

3. The hammer drill adapter as recited in claim 1, wherein:

said flat, front face further having an elongated end-to-end channel that extends between said cavity ends, and said end-to-end channel configured to accommodate a portion of the side of a flat, S-cleat within said end-to-end channel.

4. The hammer drill adapter as recited in claim 2, wherein:

said flat, front face further having an elongated end-to-end channel that extends between said cavity ends, and said end-to-end channel configured to accommodate a portion of the side of a flat, S-cleat within said end-to-end channel.

5. The hammer drill adapter as recited in claim 1, wherein:

said top and bottom surfaces of said front face are separated by a prescribed height that is set so as to allow said front face of said adapter to be used to push forward the open side of a standing S cleat from which said standing portion extends onto the edge of one of two duct sections that are to be joined together.

6. The hammer drill adapter as recited in claim 2, wherein:

said top and bottom surfaces of said front face are separated by a prescribed height that is set so as to allow said front face of said adapter to be used to push forward the open side of a standing S cleat from which said standing portion extends onto the edge of one of two duct sections that are to be joined together.

7. The hammer drill adapter as recited in claim 3, wherein:

said top and bottom surfaces of said front face are separated by a prescribed height that is set so as to allow said front face of said adapter to be used to push forward the open side of a standing S cleat from which said standing portion extends onto the edge of one of two duct sections that are to be joined together.

8. The hammer drill adapter as recited in claim 4, wherein:

said top and bottom surfaces of said front face are separated by a prescribed height that is set so as to allow said front face of said adapter to be used to push forward the open side of a standing S cleat from which said standing portion extends onto the edge of one of two duct sections that are to be joined together.

9. The hammer drill adapter as recited in claim 1, wherein:

said front face has dimensions in the range of 1.75-2.5 inches in length between said ends, and 0.8-1.25 inches in height between said top and bottom surfaces.

10. The hammer drill adapter as recited in claim 2, wherein:

said front face has dimensions in the range of 1.75-2.5 inches in length between said ends, and 0.8-1.25 inches in height between said top and bottom surfaces.

11. The hammer drill adapter as recited in claim 3, wherein:

said front face has dimensions in the range of 1.75-2.5 inches in length between said ends, and 0.8-1.25 inches in height between said top and bottom surfaces.

12. The hammer drill adapter as recited in claim 4, wherein:

said front face has dimensions in the range of 1.75-2.5 inches in length between said ends, and 0.8-1.25 inches in height between said top and bottom surfaces.

13. The hammer drill adapter as recited in claim 5, wherein:

said front face has dimensions in the range of 1.75-2.5 inches in length between said ends, and 0.8-1.25 inches in height between said top and bottom surfaces.

14. The hammer drill adapter as recited in claim 6, wherein:

said front face has dimensions in the range of 1.75-2.5 inches in length between said ends, and 0.8-1.25 inches in height between said top and bottom surfaces.

15. The hammer drill adapter as recited in claim 7, wherein:

said front face has dimensions in the range of 1.75-2.5 inches in length between said ends, and 0.8-1.25 inches in height between said top and bottom surfaces.

16. The hammer drill adapter as recited in claim 8, wherein:

said front face has dimensions in the range of 1.75-2.5 inches in length between said ends, and 0.8-1.25 inches in height between said top and bottom surfaces.

* * * * *